US006006457A

United States Patent [19]

Transport

[11] Patent Number: 6,006,457

[45] Date of Patent: Dec. 28, 1999

[54] COLLAPSIBLE THREE-DIMENSIONAL HOLLOW ORNAMENTAL STRUCTURES

[76] Inventor: Felix Transport, 98 Riverside Dr., New York, N.Y. 10024

[21] Appl. No.: 09/033,123

[22] Filed: Mar. 2, 1998

Related U.S. Application Data

[63] Continuation of application No. 08/709,341, Sep. 6, 1996, abandoned.

[51] Int. Cl.[6] ..... G09F 1/00

[52] U.S. Cl. ..... 40/124.14; 446/488; 40/720

[58] Field of Search ..... 40/124.09, 124.14, 40/124.15, 539, 720; 446/80, 388, 488

[56] References Cited

U.S. PATENT DOCUMENTS

| | | | |
|---|---|---|---|
| 3,267,597 | 8/1966 | Jannes | 40/124.14 X |
| 4,319,418 | 3/1982 | Transport | 40/124.14 |
| 4,380,133 | 4/1983 | Arnstein | 446/488 |
| 4,517,251 | 5/1985 | Mosely | 40/539 X |
| 4,773,622 | 9/1988 | Herlin | 40/539 X |
| 4,794,024 | 12/1988 | Crowell et al. | 40/124.08 X |
| 5,116,648 | 5/1992 | Martin et al. | 40/124.11 X |

*Primary Examiner*—Brian K. Green
*Attorney, Agent, or Firm*—Gottlieb, Rackman & Reisman, P. C.; Jeffrey M. Kaden; Norbert P. Holler

[57] ABSTRACT

A polyhedrally shaped collapsible ornamental hollow structure having a fully enclosed hollow interior is made from a blank cut from a single sheet of folding board or like sheet material, the blank having a dual cruciform (Greek cross-like) configuration and being provided with a plurality of longitudinal, transverse and oblique scores to enable it to be folded and glued. The hollow structure remains in the collapsed state as long as a restraining pressure is applied thereto in a direction substantially perpendicular to the opposite front and back faces of the hollow structure, but when such restraining pressure is removed the hollow structure is automatically deployed into its expanded state by virtue of a compressive force applied circumferentially to the hollow structure by an elastic band equatorially encircling the sides of the hollow structure. The blank at the intersections of its respective longitudinal and transverse blank portions has respective central square regions defining the front and back faces of the hollow structure, and each central square region is surrounded by a series of outer right triangular regions defining the side faces of the hollow structure. In a particularly preferred embodiment of the invention, the central square region defining at least the front face of the hollow structure is provided with slits in its corner regions to permit a photograph to be releasably attached to the hollow structure.

21 Claims, 9 Drawing Sheets

COLLAPSIBLE THREE-DIMENSIONAL HOLLOW ORNAMENTAL STRUCTURES

CROSS-REFERENCE TO RELATED APPLICATION

This application is a continuation of my prior application Ser. No. 08/709,341 filed Sep. 6, 1996, now abandoned.

BACKGROUND OF THE INVENTION

The invention disclosed herein relates generally to polyhedrally shaped collapsible hollow three-dimensional structures made of folding board, sometimes referred to as paperboard, or a like sheet material, and in particular to such structures each of which, when in its expanded three-dimensional state, is suitable for display as an ornament either per se or in conjunction with a photograph or an ornamental card releasably attached to an exterior face of the structure, and each of which can be collapsed, either per se or with a photograph or card attached thereto, into a flat essentially two-dimensional state.

U.S. Pat. No. 4,319,418, (the '418 patent) which was issued to the present inventor on the basis of the aforesaid prior application and the entire subject matter of which is incorporated herein by reference, discloses collapsible ornamental structures having fully enclosed hollow interiors. The collapsible ornamental hollow structures are made from a blank cut from a single sheet of folding board or paperboard or similar material, folded and bonded, and encircled by elastic bands. The collapsible ornamental structures remain in a collapsed state as long as restraining pressure is applied to them in a direction substantially perpendicular to their faces, but automatically deploy or expand by reason of the encircling elastic band when such restraining pressure is removed.

An example of the collapsible ornamental hollow structures disclosed in the '418 patent is shown in FIGS. 1 and 2 of the drawings of the present application. Blank 1 of the collapsible ornamental structure is, as shown in FIG. 1, generally cruciform (Greek cross-like) in configuration and at the juncture region of its perpendicularly intersecting bar-shaped portions 1' and 1" comprises a central square 7 having scores or fold lines 9, 11, 13, and 15 defining its sides (scores being indicated in the drawings by broken lines and cuts by solid lines). Blank 1 in the opposite end regions of its horizontal bar 1' also comprises a first polygon 25 and a third polygon 27 adjoining the diagonally opposite horizontal corner regions of the central square 7. Each of first polygon 25 and third polygon 27 includes an outer square 43 or 43' having a first side 45 or 45' hinged to colinear legs 33 and 35 or 33' and 35' of right triangles 29 and 31 or 29' and 31' and a score 47 or 47' coincident with its median perpendicular to said first side 45 or 45'. Each outer square 43 or 43' also has oblique scores 49, 51, 53 and 55 or 49', 51', 53' and 55', each of which joins the midpoints of two adjacent sides of the respective outer square. Scores 51 and 53 or 51' and 53' form with parts of the outer sides of each outer square 43 or 43' respective pairs of right triangles 50 and 52 or 50' and 52'. Blank 1 in the opposite end regions of its vertical bar 1" also comprises a second polygon 57 and a fourth polygon 59 which include flaps 83 and 85, respectively, each of which comprises a pentagon having a hinged base 87 or 87' defined by a transverse score or fold line.

The collapsible hollow structure is formed by placing adhesive on the surface of flaps 83 and 85 near the apogees 95, as shown by the stippling in FIG. 1, and folding the first, second, third and fourth polygons 25, 57, 27, and 59, respectively, on their respective scores as shown. The triangles 50 and 52 of first polygon 25 and the triangles 50' and 52' of the third polygon 27 are bonded to the surfaces of flaps 83 and 85, i.e., scores 51 and 53 and scores 51' and 53' lie adjacent to the sides of polygons 57 and 59, intersecting apogees 95. When folded in this manner blank 1 resembles the construction depicted in FIG. 2.

SUMMARY OF THE INVENTION

The present invention provides collapsible ornamental structures created from blanks having dual cruciform (Greek-like) configurations, which provides certain advantages and improvements, including increased strength, greater symmetry, and improved ease of manufacture. Also, the present invention provides collapsible ornamental hollow structures capable of supporting photographs thereon so as to provide three-dimensional appearances to the photographs.

It is an object of the present invention to provide an improved automatically deployable collapsible ornamental hollow structure which has an attractive shape and is symmetrical in appearance.

It is another object of the present invention to provide an improved collapsible ornamental hollow structure which is strong and folds easily.

It is another object of the present invention to provide a novel form of blank for such collapsible ornamental hollow structures which may be cut from a single continuous sheet of material.

It is another object of the present invention to provide such collapsible ornamental hollow structures which deploy automatically from a flat folded essentially two-dimensional condition to an expanded three-dimensional condition upon removal of restraints holding them in their folded state.

It is another object of the present invention to provide such collapsible ornamental hollow structures in which inexpensive elastic bands serve to expand the structures and keep them in that state unless they are physically restrained against expanding.

It is another object of the present invention to provide a collapsible ornamental hollow structure as aforesaid which is adapted for supporting a photograph or a decorative or informative card in a manner which provides for easy replacement of the photograph or card.

It is another object of the present invention to provide a collapsible ornamental hollow structure as aforesaid which is adapted for the display of a photograph or other informative card thereon in a manner which permits the photograph or card to move slightly in place and take on a three-dimensional appearance when the structure is expanded.

The above and other objects are achieved by a collapsible hollow polyhedrally shaped structure which is formed from a single blank and has in the expanded state thereof a front and rear face and a plurality of sides. The blank comprises first and second opposing identical main polygonal sections each of which is cruciform in configuration, essentially in the fashion of a Greek cross, and which sections are hinged together on a common side centrally of the horizontal bar portion of the blank. The first and second main polygonal sections contain respective central polygonal, preferably square, regions which in the expanded state of the hollow structure form the front and rear faces of the polyhedrally shaped structure, and respective pluralities of generally right triangular outer polygonal regions each of which has at least one side coincident with and hinged to at least part of a side of the respective central polygonal region. In the expanded polyhedrally shaped hollow structure, the outer polygonal regions define at least part of the sides of the polyhedron.

The first main polygonal section also contains a plurality of tabs extending beyond the outwardly directed sides of the respective outer polygonal regions, each tab having a side coincident with and hinged to an outer side of an outer polygonal region in the first main polygonal section, each tab being folded in the expanded condition of the polyhedrally shaped structure to align with and overlie an outer polygonal region of the second main polygonal section which corresponds to the outer polygonal region of the first main polygonal section to which the tab is hinged.

If desired to achieve a star-like configuration of the collapsible hollow structure, the blank therefor may comprise scores coincident with median and diagonal lines of at least one or each central square region. Alternatively, the scores may be omitted, thus providing generally flat, smooth surfaces for the front and rear faces of the hollow structure.

In some embodiments, when the outer polygonal regions comprise right triangles, the hypotenuse side edge of each outer polygonal region is coincident with and hinged to part of a side of the central square region. In these embodiments, the hinged common side between the first and second main polygonal sections may be formed by coincident and hinged legs of those outer polygonal regions which are positioned in the area of the blank between the two central square regions. Also, the tabs may be right triangles of substantially the same size and proportion as the outer polygonal regions, each tab having a leg side edge coincident with and hinged to an outer leg side edge of the corresponding outer polygonal region. Preferably, the outer polygonal regions and the tabs comprise isosceles right triangles, each thus having two 45° angles along with the single 90° angle.

Corners of the tabs formed between the hypotenuse of each tab and the leg thereof which is coincident with the outer leg of the corresponding outer polygonal region are removed to thereby form slits for accommodating the elastic band required to achieve the deployed condition of the hollow structure. An additional slit for this purpose may also be provided in the hinged common side between the first and second main polygonal sections.

To retain photographs or decorative and/or informative cards on the front face of the collapsible ornamental hollow structure, at least one of the central square regions in the first and second main polygonal sections of the blank has a plurality of slits provided therein near the corners or sides of the at least one central square region. The slits, in a particular embodiment of the invention, may be curved and positioned near the four corners of the central square region.

In another embodiment of the invention, the blank is further provided with scores or fold lines coincident with straight lines running from the midpoint of each side of one or both of the central square regions to the midpoint of each adjacent side of the same central square region, such scores thereby forming within one or both of the central square regions a respective internal square region which is rotated 45° with respect to the surrounding central square region. Respective preferably rectilinear slits are provided near the four corners of the internal square region and extend from one side of the internal square region to an adjacent side. Curved slits may also be positioned near the corners of the central square region, thus providing two sets of slits and thereby two ways in which a photograph or card may be attached to the collapsible structure.

Some or all of the objects of the present invention are also achieved by a hollow collapsible polyhedrally shaped structure constructed from a single blank and having in the expanded or deployed condition thereof opposing faces and a plurality of sides. The blank comprises first and second main polygonal sections hinged together on a common side. The first main polygonal section comprises a first central square region forming in the expanded state of the polyhedrally shaped hollow structure one of the opposing faces of the latter, and a plurality of first outer polygonal regions each of which has at least one side coincident with and hinged to at least part of a side of the first central square region.

The second main polygonal section comprises a second central square region substantially equal in size to the first central square region and forming in a deployed condition of the polyhedrally shaped structure another of the opposing faces of the latter, and a plurality of second outer polygonal regions each having a side coincident with and hinged to at least part of a side of the second central square region. The second outer polygonal regions of the blank extend further from the second central square region than the first outer polygonal regions extend from the first central square region. Each second outer polygonal region is creased at or near the midline thereof so as to be foldable upon itself.

In some embodiments, the first outer polygonal regions of the blank comprise right triangles, each being hinged at its hypotenuse side edge to part of a side of the first central square region. In these embodiments, the second outer polygonal regions are generally right triangles each having an area approximately double the area of a first outer polygonal region and having a small section removed near the right angle thereof to form part of a slit for holding the elastic band in place in the deployed condition of the collapsible structure. Preferably, the first and second outer polygonal regions are isosceles right triangles.

In alternative embodiments, the first outer polygonal regions facing away from the common side between the first and second main polygonal sections of the blank comprise trapezoidal regions, each being hinged at the base thereof to all or part of a side of the first central square region, and the second outer polygonal regions comprise rectangles. The blank may further comprise scores or fold lines coincident with diagonals of at least some of the second outer polygonal regions.

Some of the objects of the present invention are also achieved by a hollow collapsible ornamental three-dimensional structure which can assume a plurality of states including a collapsed state and an expanded state, the hollow structure being constructed from a single blank and having two opposite surfaces and a plurality of sides. One of the surfaces comprises a polygonal outer face which is generally flat in the collapsed state of the structure but is bent in the expanded state of the hollow structure and has first sections which form part of the sides of the hollow structure when the same is in the expanded state. The surface also contains a polygonal inner face within the outer face which is generally flat in both the collapsed and expanded states of the hollow structure, the inner face having vertices coincident with points on the sides of the outer face, the inner face not including any of the first sections of the outer face.

In addition, the surface contains a plurality of slits positioned in the first sections of the outer face to receive corner regions of a photograph or card releasably attachable to the hollow structure in a bent fashion. In preferred embodiments, the slits are curved. Due to the placements of the slits, the photograph inserted therein is bent and assumes an interesting, three-dimensional appearance.

BRIEF DESCRIPTION OF THE DRAWINGS

The invention is illustrated in the figures of the accompanying drawings which are meant to be exemplary and not limiting, in which like references refer to like or corresponding parts, and in which.

DETAILED DESCRIPTION OF THE PREFERRED EMBODIMENTS

Several embodiments of the present invention are described with reference to the drawings in FIGS. 3–12.

Figure 1:
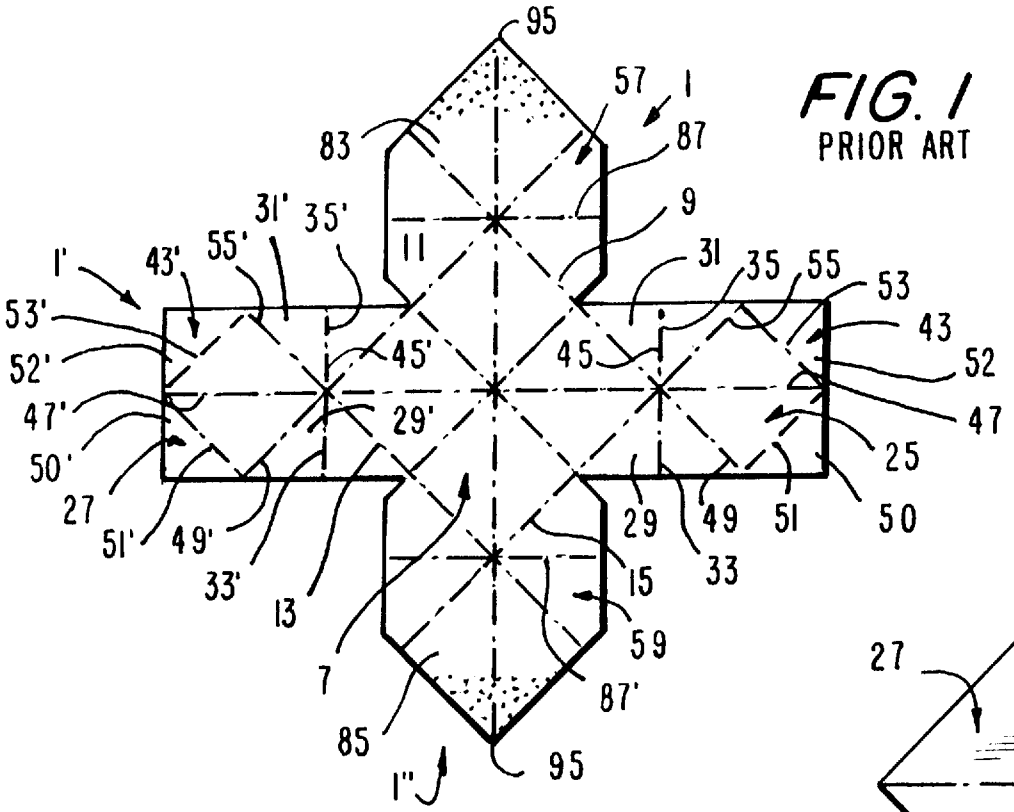
FIG. 1 PRIOR ART
FIG. 1 is a plan view of a blank for making a prior art collapsible ornamental hollow structure, the blank being shown in the state thereof after cutting, scoring and glue application but prior to folding and final bonding.
Figure 2:
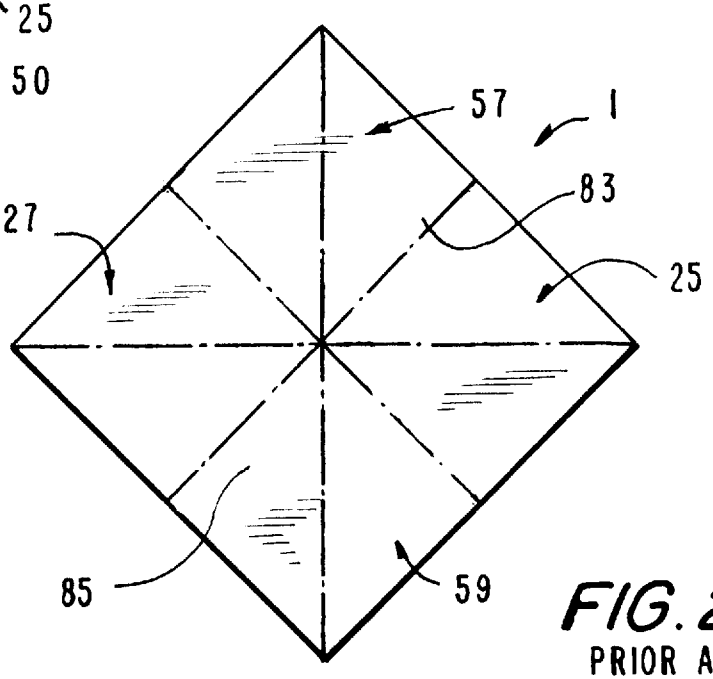
FIG. 2 PRIOR ART
FIG. 2 is a plan view of the folded and bonded, but undeployed, prior art collapsible ornamental hollow structure made from the blank shown in FIG. 1.
Figure 3:
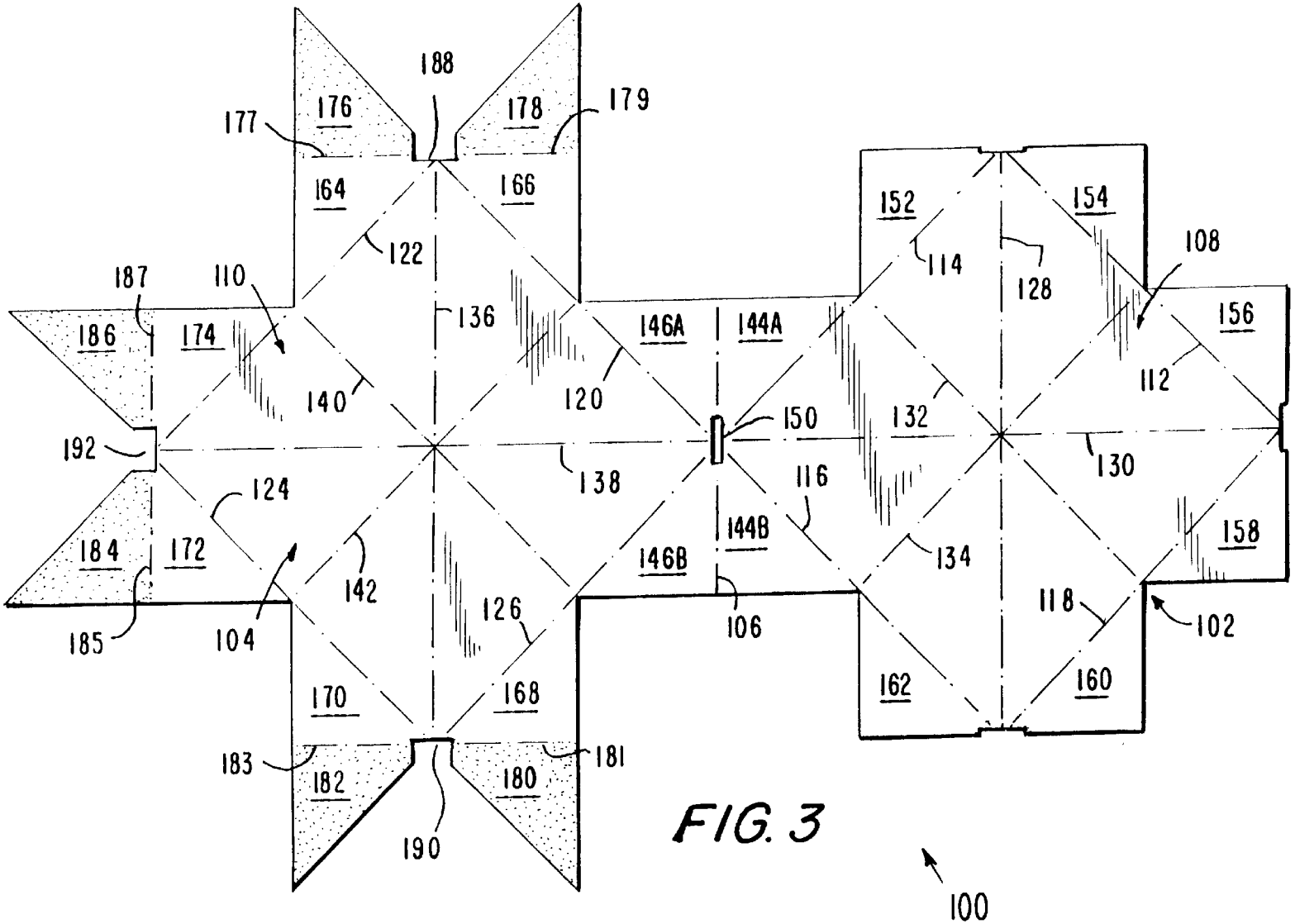
FIG. 3 is a plan view of a blank for making a collapsible ornamental hollow structure according to one embodiment of the present invention, the blank being shown in the state thereof after cutting and scoring, but prior to folding, glue application, and bonding.

With reference to FIG. 3, blank 100 for one preferred embodiment of the hollow collapsible ornamental structure of the present invention comprises two essentially identically cruciform (Greek cross-like) polygonal sections 102 and 104 the longitudinal blank portions of which are hinged to each other centrally of the blank by a common medial transverse score or fold line 106. The polygonal sections 102 and 104 have identical central square regions 108 and 110, respectively, with central square region 108 being defined by scores 112, 114, 116, and 118 and central square region 110 being defined by scores 120, 122, 124, and 126.

Figure 5:
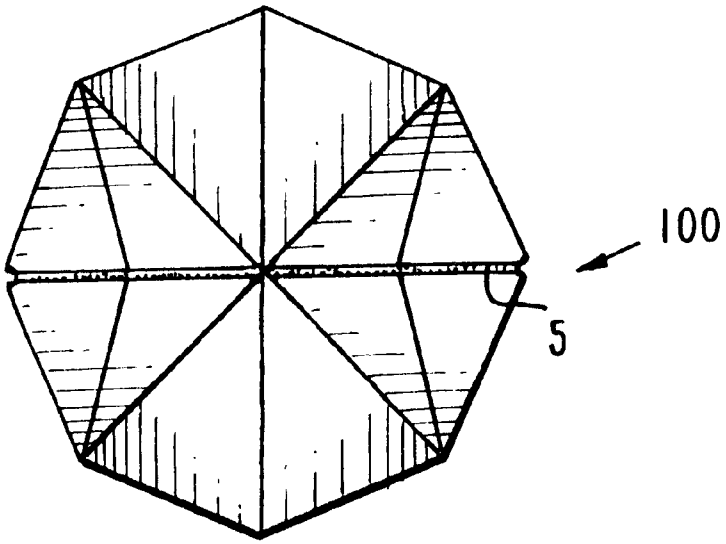
FIG. 5 is a side elevational view of the fully deployed collapsible ornamental hollow structure made from the blank shown in FIG. 3.
Figure 4:
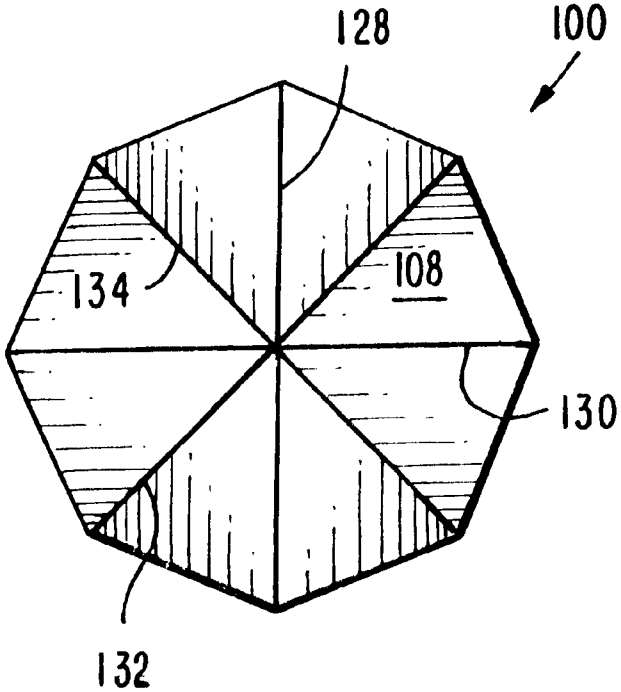
FIG. 4 is a front elevational view of the fully deployed collapsible ornamental made from the blank shown in FIG. 3.
Figure 6:
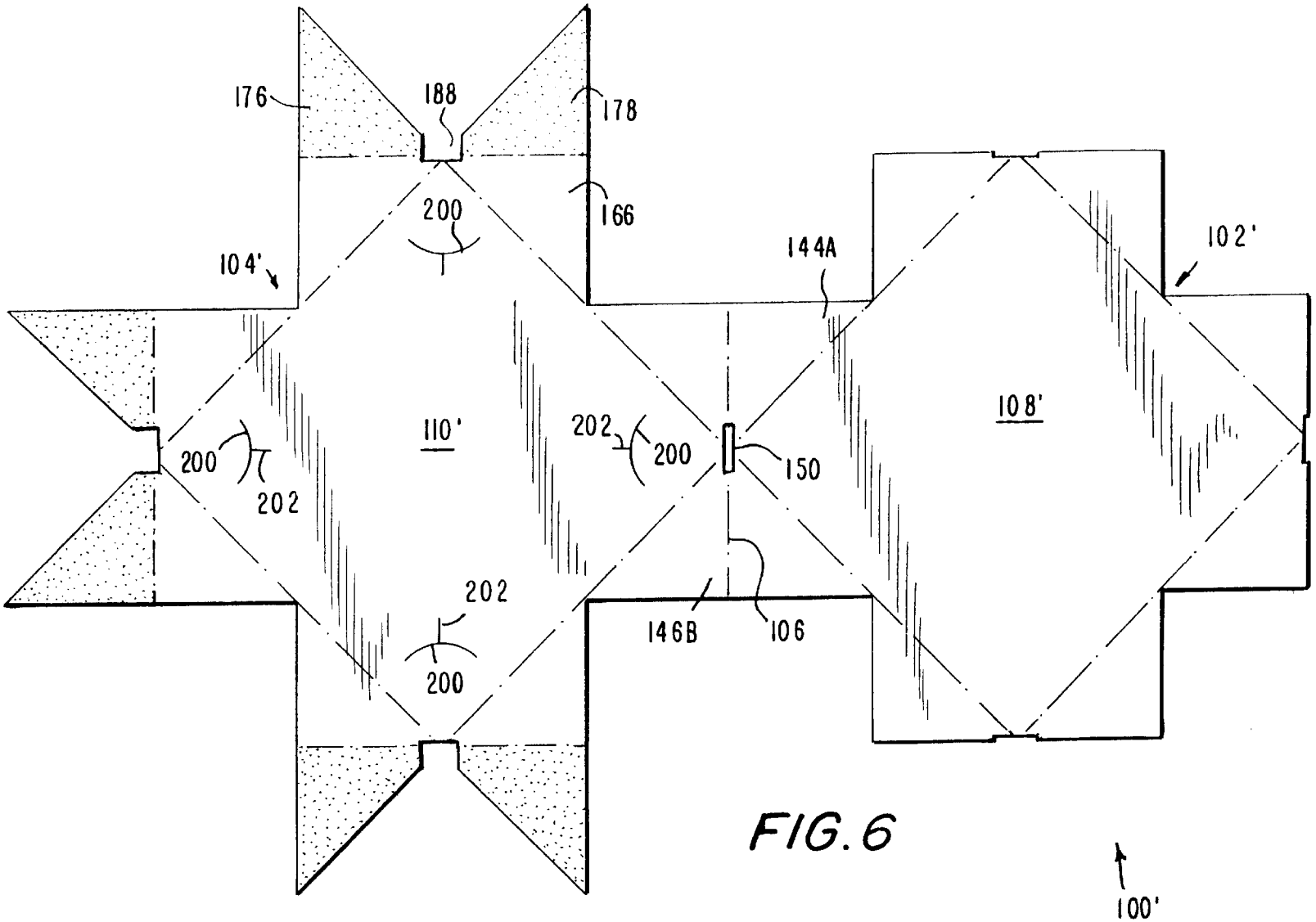
FIG. 6 is a plan view of a modified blank for making a collapsible ornamental hollow structure according to the present invention, the blank being shown in the state thereof after cutting and scoring, but prior to folding, glue application, and bonding.

The blank 100 shown in FIG. 3 contains scores 128 and 130 coincident with the diagonals of square region 108 and scores 132 and 134 coincident with the medians of square region 108. Similarly, scores 136 and 138 are coincident with the diagonals of square region 110 and scores 140 and 142 are coincident with the medians of square region 110. These scores provide roughly star-shaped oppositely directed front and back faces for the collapsible hollow structure when the blank 100 is folded, glued and deployed as shown in FIGS. 4 and 5. If flat surfaces are desired, these scores are omitted as shown in the embodiment of FIG. 6.

Right triangular regions 144A and 146A located centrally of the blank between square regions 108 and 110 each have one leg side edge coincident with each other and constituted by a portion of the medial transverse score or hinge 106. Similarly, right triangular regions 144B and 146B each have one leg side edge colinear with the coincident leg side edges of triangular regions 144A and 146A, respectively, and constituted by another portion of the common medial transverse score line or hinge 106. Right triangular regions 144A and 144B have hypotenuse side edges which are coincident with half of scores 114 and 116, respectively, and right triangular regions 146A and 146B have hypotenuse side edges which are coincident with half of scores 120 and 126, respectively. Triangular regions 144A, 144B, 146A and 146B, which constitute parts of the connection between the first and second polygonal sections 102 and 104 of the blank, form part of the sides of the collapsible ornamental hollow structure in its expanded state.

A small slit 150 is positioned near the center of the medial transverse score line 106 and oriented longitudinally of the latter and perpendicular to colinear scores 130 and 138. The slit 150 is provided to accommodate a portion of an encircling elastic band used to force the collapsible ornamental hollow structure into an expanded or deployed condition.

Polygonal section 102 also contains six right triangular regions 152, 154, 156, 158, 160, and 162 hinged at their hypotenuse side edges to square region 108 along parts of scores 114, 112, 118, and 116, respectively. Similarly, polygonal section 104 has six right triangular regions 164, 166, 168, 170, 172, and 174 hinged at their hypotenuse side edges to square region 110 along parts of scores 122, 120, 126, and 124, respectively. Along with triangular regions 144A, 144B, 146A and 146B, these additional right triangular regions hinged to square regions 108 and 110 form part of the sides of the collapsible ornamental hollow structure in its deployed condition.

Polygonal section 104 is further provided with tabs 176, 178, 180, 182, 184, and 186 each of which is hinged at one side edge thereof to a corresponding side edge of a respective one of right triangular regions 164, 166, 168, 170, 172, and 174, respectively, by virtue of scores 177, 179, 181, 183, 185 and 187, respectively. The illustrated tabs are essentially right triangular regions identical in size and shape to the right triangular regions 152, 154, 156, 158, 160 and 162, respectively, which are hinged to square region 108 in polygonal section 102. A small section of each tab 176, 178, etc. is removed at an acute angle corner thereof adjacent to the associated ones of the triangular regions 164, 166, etc. in polygonal section 104. These removed sections form slits 188, 190 and 192 similar to the slit 150 and together with the latter, in a deployed condition of the collapsible ornamental hollow structure, constitute means for accommodating portions of the encircling elastic band and for retaining it in place on the hollow structure.

In preferred embodiments, all the right triangular regions have the shape of isosceles right triangles, each thus having one 90° angle and two 45° angles. It will be understood that having all the scores, fold lines and cuts oriented either parallel to the longitudinal center line of the blank or at an angle of either 90° or 45° to the longitudinal center line of the blank, so that when such scores, fold lines and cuts intersect one another they do so only at an angle of either 90° or 45°, facilitates proper folding and matching of corresponding opposing elements of the blank.

Figure 3A:
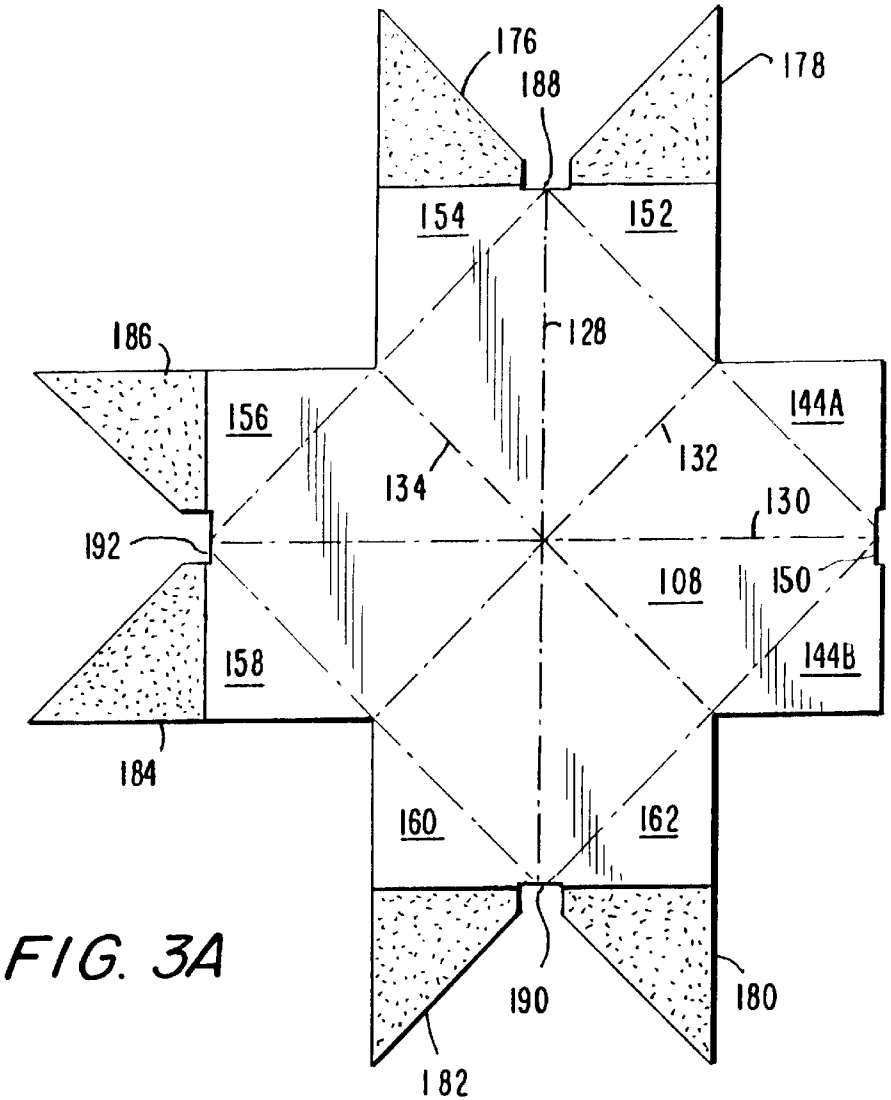
FIG. 3A is a plan view of the blank of FIG. 3 after initial folding and glue application, but prior to final folding and bonding.

Blank 100 is assembled and deployed as follows. Polygonal section 102 is folded over polygonal section 104 along the common medial transverse hinge or score line 106. As a result, square regions 108 and 110 are congruent and aligned and the right triangular regions surrounding square region 108 are congruent and aligned with the corresponding right triangular regions surrounding square region 110. The result at this point is shown in FIG. 3A. Adhesive or glue is then applied to either the inside surfaces of the tabs 176, 178, 180, 182, 184, and 186 and/or the outside surfaces of the right triangular regions 152, 154, 156, 158, 160, and 162. The tabs are then folded over the respective right triangular regions of polygonal section 102, to which they adhere by virtue of the glue. One skilled in the art will recognize that the blank 100 may be folded and bonded in other ways, for example, by applying the glue to the tabs before folding the blank 100.

Once the blank 100 is folded and bonded, all the right triangular regions in polygonal sections 102 and 104 are pushed inward and folded towards the interior of the collapsible ornamental hollow structure along the scores defining the square regions 108 and 110. The elastic band 5 (see FIG. 5) is then stretched around the circumference of folded blank 100 and deposited essentially equatorially on the hollow structure so as to have portions of the band lie in slits 150, 188, 190 and 192. The elastic band 5 applies inwardly directed pressure circumferentially to the sides of the collapsible ornamental hollow structure so as to cause it to be deployed or expanded, as shown in FIGS. 4 and 5. As explained above, and as further shown in FIGS. 4 and 5, the scores along the diagonal and median lines of square regions 108 and 110 cause the latter and thereby the ornamental hollow structure as a whole to assume a roughly star-like configuration.

As one skilled in the art will recognize, as long as pressure is maintained upon and approximately perpendicular to the flat surfaces of polygonal sections 102 and 104 of blank 100, the collapsible ornamental hollow structure will remain in a relatively flat, collapsed configuration. However, when such pressure is relieved, the force created by elastic band 5 will cause the collapsible ornamental structure of FIG. 3 to deploy or expand and resemble the structure shown in FIGS. 4 and 5.

Another embodiment of the invention is shown in FIGS. 6–9. This blank 100' is essentially the same as blank 100 as shown in FIGS. 3–5, i.e., it has a dual cruciform configuration characterized by central square regions 108' and 110' in the two main polygonal sections 102' and 104' of the blank and associated sets of right triangular outer polygonal regions and tabs. The blank 100' differs from the blank 100 primarily in that the scores 128, 130, 132, 134, 136, 138, 140, and 142 are omitted, thus providing opposed smooth front and back surfaces on the collapsible ornamental hollow structure when in its deployed condition. See FIGS. 7 and 9. Also, blank 100' contains four curved slits 200 positioned in the four corner regions of central square region 110', and small slits 202 perpendicular to the tangents of the centers of the curved slits 200. The curved slits 200 are preferably arranged symmetrically as shown. The slits 200 are sized to enable the corner regions of a photograph 135 (or, if desired, of some other type of informative or ornamental card) to be slipped therethrough, as shown in FIG. 7A. It will be understood that by virtue of this arrangement the photograph or card can be releasably attached to and supported by the collapsible hollow structure in overlying relation to the front face thereof defined by central square region 110'. In a hollow collapsible structure according to the embodiment of FIG. 6, therefore, the dominant ornamental feature thereof is the photograph or card, but the ornamental impact of that structure can be readily changed by simply replacing the photograph or card by another such object without the structure itself having to be replaced. In a hollow collapsible structure according to the embodiment of FIG. 3, on the other hand, the intrinsic ornamental features of the structure itself are fixed, i.e., they are permanent parts of the structure, and the ornamental impact of the hollow structure thus cannot be changed without either replacing the entire structure or making an essentially permanent modification of its facial decor.

Figure 9:
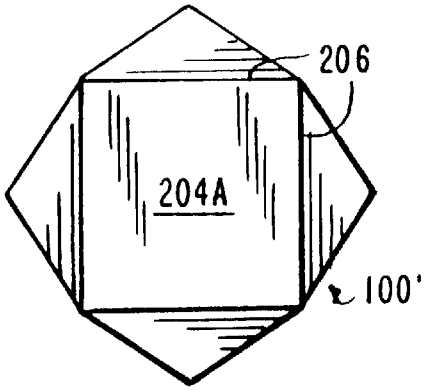
FIG. 9 is a rear elevational view of the fully deployed collapsible ornamental hollow structure made from the blank of FIG. 6.
Figure 8:
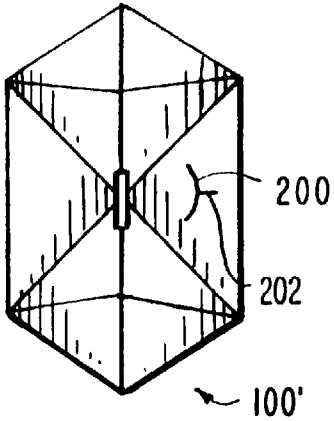
FIG. 8 is a side elevational view of the fully deployed collapsible ornamental hollow structure made from the blank of FIG. 6, shown without a photograph attached thereto.
Figure 7:
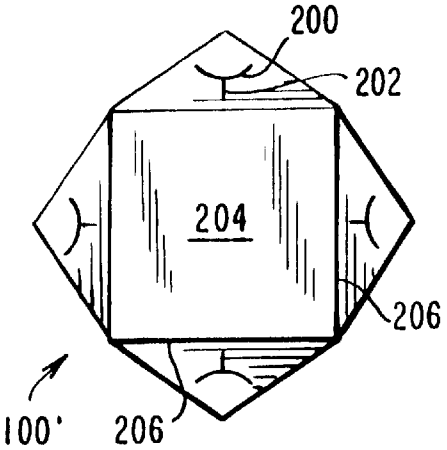
FIG. 7 is a front elevational view of the fully deployed collapsible ornamental hollow structure made from the blank of FIG. 6, shown without a photograph attached thereto.
Figure 7A:
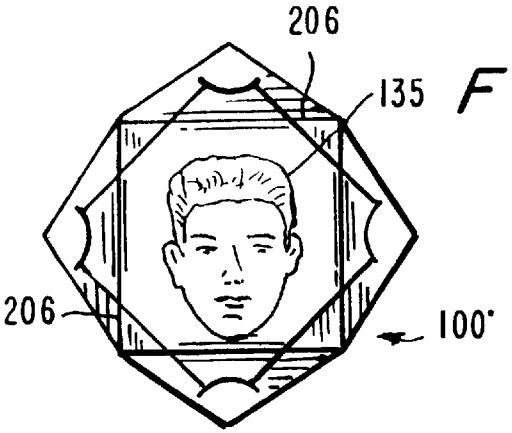
FIG. 7A is a front elevational view of the fully deployed collapsible ornamental hollow structure made from the blank of FIG. 6, shown with a photograph attached thereto.

Referring to FIGS. 7 and 9, in a deployed condition of the folded and glued blank 100' an inner square region 204 or 204A is formed at each of the front and back faces of the collapsible ornamental hollow structure, with the inner square regions being rotated 45° with respect to outer square regions 108' and 110' and being defined by respective sets of bends 206 created when the right triangular regions of the blank surrounding and hinged to the outer square regions are folded down and inward in accordance with the deploying process described above. The curved slits 200 are preferably positioned in their respective outer square region 110' so as to end up outside the associated inner square region 204 and within the corner regions of the said outer square region which are bent downward and thereby form parts of the sides of the collapsible ornamental hollow structure.

In this configuration, the corner regions of a photograph or card 135 attached to the collapsible ornamental hollow structure are bent downward and away from the plane of the central portion of the photograph, with the corner regions of the photograph or card being able to slip slightly outwardly of the slits during this movement, by virtue of which the photograph or card assumes an interesting and esthetically attractive three-dimensional appearance. Of course, the photograph or card may have to be cut or taken on a 45° angle to allow for proper orientation of the subject of the photograph or card relative to the collapsible ornamental hollow structure as shown in FIG. 7A.

Figure 10:
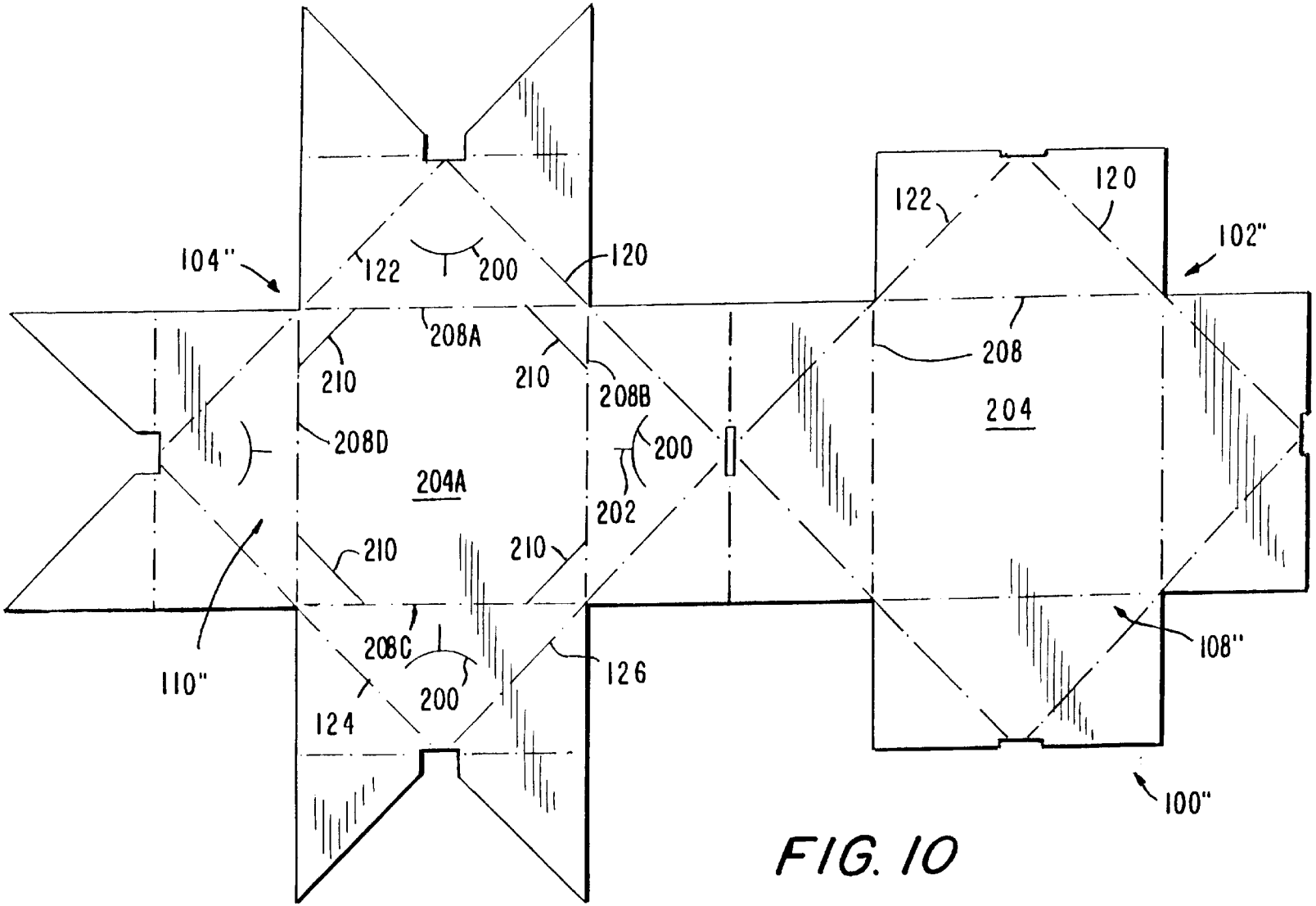
FIG. 10 is a plan view of a further modified blank for making a collapsible ornamental hollow structure according to the present invention, the blank being shown in the state thereof after cutting and scoring, but prior to folding, glue application, and bonding.
Figure 11A:
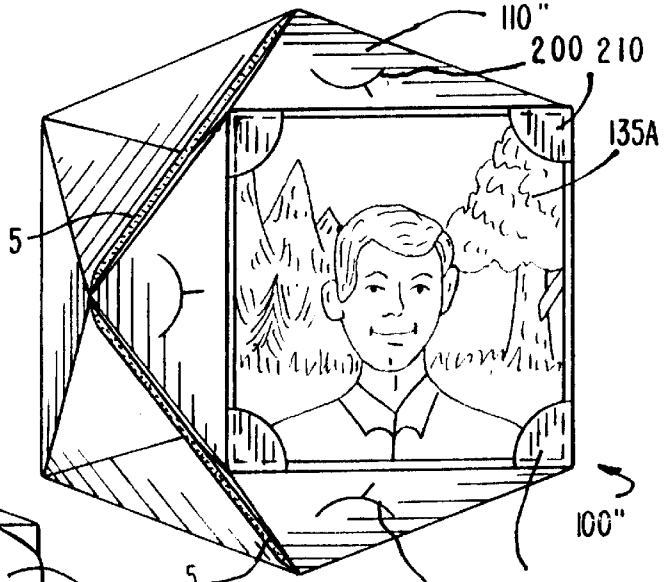
FIG. 11A is a perspective elevational view of the fully deployed collapsible ornamental hollow structure made from the blank of FIG. 10, shown with a photograph attached thereto by insertion of the corner regions of the photograph into rectilinear corner slits in the inner square face of the collapsible ornamental hollow structure.
Figure 11B:
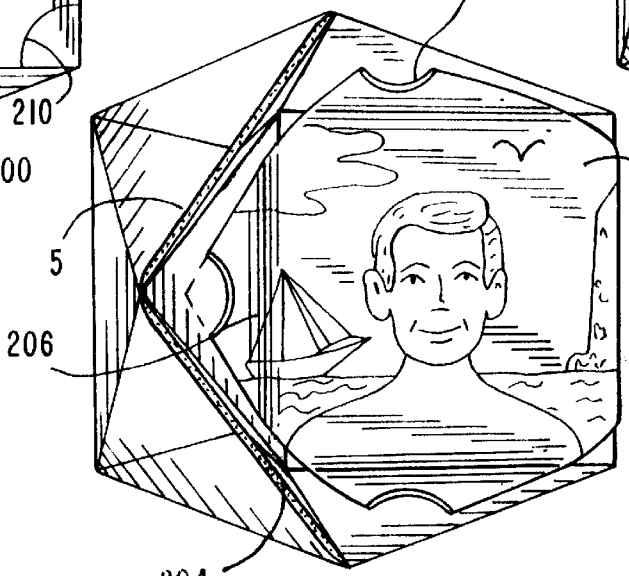
FIG. 11B is a perspective elevational view of the fully deployed collapsible ornamental hollow structure made from the blank of FIG. 10, shown with a photograph attached thereto by insertion of the corner regions of the photograph into curved corner slits which are provided in the outer square region of the collapsible ornamental hollow structure but in the deployed condition of the latter are located on the sides thereof.
Figure 11:
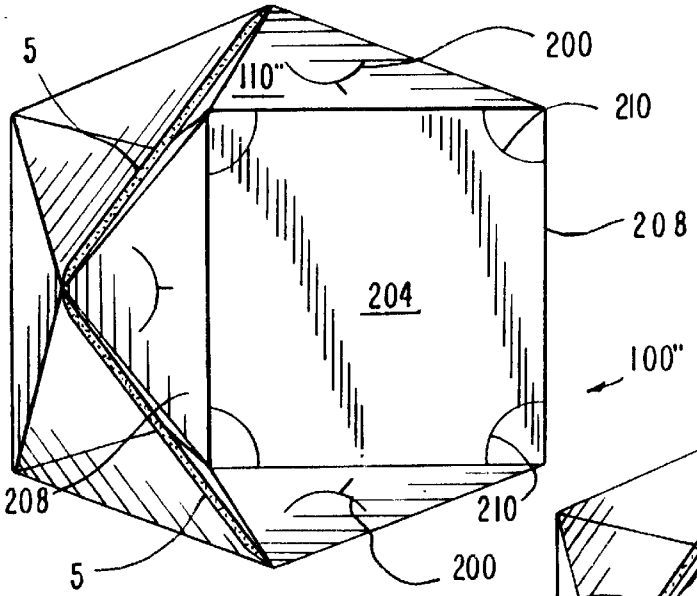
FIG. 11 is a perspective elevational view of the fully deployed collapsible ornamental hollow structure made from the blank of FIG. 10, shown without a photograph attached thereto.

As in the further embodiment of the present invention shown in FIGS. 10–11B, scores 208 may be provided in the blank 100" to help define the inner square regions 204 and 204A within the two cruciform main polygonal sections 102" and 104" of the blank and the outer central square regions 108" and 110" thereof. The scores 208 (which are so designated only in the main polygonal section 102" but exist in the other main polygonal section 104" as well) are coincident with straight lines extending from the midpoint of each score 120, 122, etc. defining the central square regions 108" and 110" to the midpoint of each adjacent score defining the said central square regions. For example, as shown in FIG. 10 in the left-hand main polygonal section 104", score 208A extends from the midpoint of score 120 to the midpoint of score 122, and score 208B extends from the midpoint of score 120 to the midpoint of score 126, and so on for scores 208C and 208D. The use of scores 208 to define the inner square regions 204 and 204A reduces the resistance to folding that may be met in forming the bends 206 in a blank of unscored folding board or like sheet material and helps to balance the tension on the ornamental hollow structure when pressure is applied to its front and back faces essentially perpendicularly thereto to collapse the hollow structure and flatten it into its two-dimensional state. The scores 208 also minimize the tension to which the elastic band 5 would ordinarily have to be subjected in order to enable the band to exert sufficient force to keep the blank bent along the bend lines 206. The use of scores 208 generally increases the reusability and shelf life of the collapsible ornamental hollow structure.

The blank 100" shown in FIG. 10 includes in the main polygonal section 104" thereof, apart from the already mentioned curved slits, four additional rectilinear slits 210 positioned in the corner regions of inner square region 204A and extending along straight lines each intersecting at one end with one of the scores 208A–208D and at the other end with an adjacent one of the scores 208A–208D. In FIG. 11, the blank 100" is shown in its folded and glued condition and with the hollow ornamental structure in its expanded state, but without any photograph attached. The slits 210 are sized and positioned for the easy insertion of the corner regions of a photograph 135A, so as to be releasably attached to the hollow ornamental structure in a generally flat planar state and in generally parallel overlying relation to inner square region 204A, and the photograph will remain in that state regardless of whether the hollow ornamental structure is expanded, as shown in FIG. 11A, or collapsed.

Alternatively, the corner regions of a photograph 135B may be inserted into the curved slits 200, which can be done either while the hollow ornamental structure is collapsed or while it is expanded. In the former case, after the photograph is inserted into the slits 200 while it is in its flat state, the hollow ornamental structure is permitted to expand, whereupon, because the slits 200 are then located at the sides of the hollow structure and not at its top, the corner regions of the photograph will become bent arcuately over the bends 206 generally defined at the locations of the boundary scores 208A–208D of the inner square region 204A. During the expansion movement of the hollow structure, it should be noted, the corner regions of the photograph remain confined in the slits 200 but are drawn slightly outwardly of the slits to accommodate the bending action.

On the other hand, attaching a photograph to the collapsible hollow structure while the latter is already in its expanded state will entail some pre-attachment bending of the photograph. Thus, after one corner region of the photograph has been inserted into one of the four slits 200, which at that time are located on the sides of the hollow structure rather than at its top, the insertion of the remaining three corner regions of the photograph into their respective slits is achieved by first bending the body of the photograph across the top or front face of the hollow structure and by then bending the three still free corner regions of the photograph individually down over the corresponding bends 206 at the boundaries of the front face of the hollow structure and slipping them into the slits.

As a result of either of these two attachment methods, the photograph, as shown in FIG. 11B, ends up being disposed in a curved or somewhat arched orientation over the front face and parts of the side faces of the hollow structure, by virtue of which a three-dimensional character and an esthetically highly attractive appearance are imparted to the photograph, as already described above.

In the embodiments of the present invention shown in FIGS. 3–10, glue or other adhesive is applied to six separate tabs and/or the corresponding ones of the right triangular outer regions of the blank in order to properly bond those tabs and regions to each other so as to transform the blank into the desired hollow collapsible ornamental structure. This requirement is reduced by half in the further embodiment of the invention shown in FIG. 12. Some of the reference numerals used in the other embodiments are retained in FIG. 12 to refer to elements matching those described above.

Figure 12:
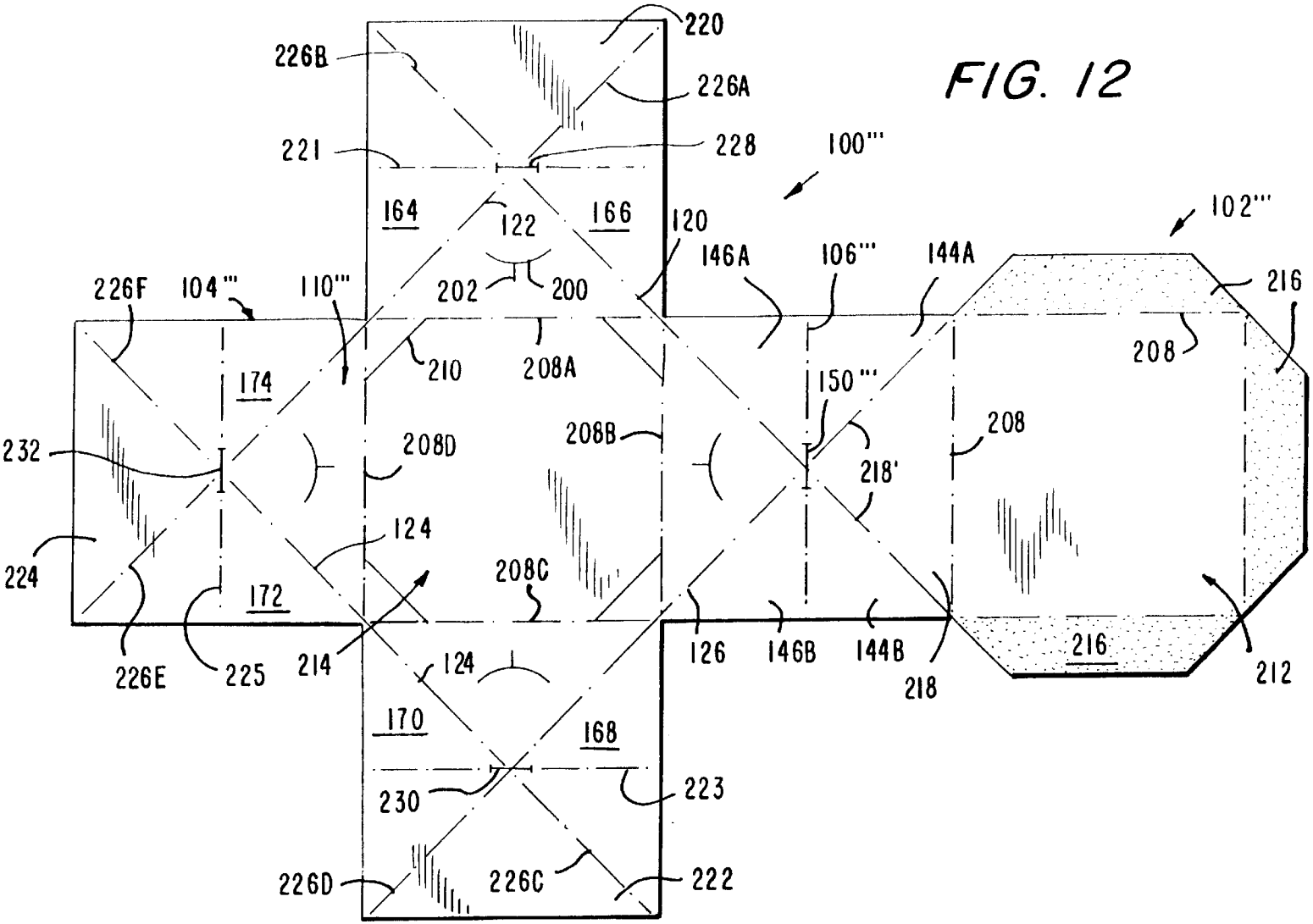
FIG. 12 is a plan view of yet a further modified blank for making a collapsible ornamental hollow structure according to the present invention, the blank being shown in the state thereof after cutting and scoring, but prior to folding, glue application, and bonding.

As shown in FIG. 12, blank 100"' includes main polygonal sections 102"' and 104"' hinged together at a common medial transverse hinge or score line 106"' having slit 150"' therein for accommodating a portion of elastic band 5 (not shown in this view) and retaining it in place on the hollow ornamental structure. In this embodiment of the invention, main polygonal section 104"' of the blank is cruciform (Greek cross-like) in configuration and has, as will be more fully described below, outer and inner central square regions 110"' and 214. Main polygonal section 102"' of the blank, however, is not cruciform in outline but rather consists of only a longitudinal blank portion and includes no outer and inner square regions but rather only a single central square region 212 the size and orientation of which are the same as those of the inner square region 214 of the polygonal section 104"'. Square region 212 of the blank 100"' is defined by four scores 208 and has three trapezoidal regions or tabs 216 having base side edges coincident with and hinged to those three of the four scores 208 which are remote from the medial transverse score or hinge 106"'. Polygonal section 102"' also includes an isosceles right triangular region 218 which is located in the area between the fourth score 208 and the medial transverse score or hinge 106"'. The right triangular region 218 has its hypotenuse side edge coincident with and defined by the said fourth score 208 and has its two leg side edges coincident with and defined by scores 218' which also constitute the hypotenuse side edges of the right triangular regions 144A and 144B.

As previously mentioned, the main polygonal section 104"' of blank 100"' is cruciform (Greek cross-like) in configuration and, like the blank 100"' of FIG. 10, includes a central outer square region 110"' defined by scores 120, 122, 124 and 126, an inner square region 214 defined by scores 208A–208D intersecting at their opposite ends the midpoints of adjacent ones of the scores 120, 122 etc., curved slits 200/202 in the corner regions of the outer square region 110''' and rectilinear slits 210 in the corner regions of the inner square region 214, and outer right triangular regions 146A, 146B, 164, 166, 168, 170, 172 and 174, all as described above. Polygonal section 104''' also includes outer rectangular regions 220, 222 and 224 hinged by scores 221, 223 and 225, respectively, to colinear legs of adjacent pairs of right triangular regions 164/166, 168/170 and 172/174. The rectangular regions 220, 222 and 224 include respective pairs of intersecting scores 226A–226B, 226C–226D and 226E–226F which are colinear with the scores 122–120, 124–126 and 122–124 forming the sides of the outer square region 110''' and which are also coincident with straight lines extending from the centers of the respective scores 221, 223 and 225 towards opposite outer corners of the rectangular regions 220, 222 and 224. Small slits 228, 230 and 232 are provided in the scores 221, 223 and 225, respectively, for accommodating portions of the elastic band and retaining it in place on the glued and folded blank 100''' in the expanded or deployed state of the latter.

The blank 100''' shown in FIG. 12 is assembled and deployed as follows. Glue is applied to the outside surfaces of trapezoidal regions or tabs 216. Polygonal section 102''' is folded over polygonal section 104''' at the medial transverse score or hinge 106''' so that square region 212 of polygonal section 102''' is congruent with corresponding inner square region 214 of polygonal section 104'''. Rectangular regions 220, 222 and 224 are folded over at scores 221, 223 and 225, respectively, so as to bring the outer parts of the rectangular regions into contact with the glue-bearing surfaces of the trapezoidal regions or tabs 216, thus bonding the blank 100'''. The right triangular regions 144A, 144B, 146A, 146B, 164, 166, 168, 170, 172 and 174 are then, by pressure applied to the perimeter of the blank, pushed and folded inwardly of the blank along their respective scores so as to displace the square regions of the blank perpendicularly away from each other, thereby to deploy the blank into the form of the hollow collapsible ornamental structure in its expanded condition. Lastly, the elastic band 5 is placed essentially equatorially around the expanded hollow structure in the plane of the locus of the small slits 150''', 228, 230 and 232, whereby respective parts of the elastic band are received in those slits so as to ensure that the band is retained in place on the hollow structure and continually urges the latter to remain in its expanded state.

After these operations have been completed, the deployed blank 100''' then appears substantially identical to the deployed blank 100'', as shown in FIGS. 11, 11A and 11B, with a photograph 135A or 135B (or some other type of ornamental or informative card) being supported by the collapsible hollow structure in either a planar and essentially two-dimensional condition as shown in FIG. 11A or in an arched and somewhat three-dimensional condition as shown in FIG. 11B. An application of sufficient pressure to the expanded hollow structure in a direction perpendicular to the front and back faces of the structure will, of course, overcome the forces exerted on the hollow structure by the encircling elastic band and will shift the hollow structure into its collapsed and essentially flat and two-dimensional state, in which the structure will remain until the pressure is released.

As one skilled in the art will recognize, blank 100''' shown in FIG. 12 may be made without scores 208A–208D in polygonal section 104''' and without slits 200, 202 and 210.

As described in U.S. Pat. No. 4,319,418, which is incorporated by reference herein, many options or accessories may be provided to the collapsible ornamental hollow structures of the present invention depending on the desired effect. For example, blanks for ornamental spires may be provided, the spires being releasably attachable to the collapsible ornamental hollow structures as described in the patent. Holes may be provided on the sides of a collapsible ornamental hollow structure according to the present invention for the insertion of string by which to hang the hollow structure from a suitable support, or conventional ornament hangers may be attached to the hollow structure by hooking them through holes or in support of the elastic band. Also, ornamental designs may be placed on the surface of the hollow structure, or holes may be provided on a face of the hollow structure for the placement of a photograph in the interior of the hollow structure. Still further, a hollow structure according to the present invention may be made commercially available, merely by way of example, as an ornamental component of a greeting card or the like, in which case the confinement of the card in an envelope will serve to apply the perpendicular pressure to the hollow structure and to keep it in its collapsed state until the card is taken out of the envelope. Alternatively, a collapsible hollow structure according to the present invention may be confined inside a book, for example as a decoration or keepsake, in which case the book itself either under its own weight if laid horizontal or when standing confined between other books or bookends will serve to apply the perpendicular pressure to the hollow structure and to keep it in its collapsed state until the book is opened.

While the invention has been described and illustrated in connection with preferred embodiments, many variations and modifications as will be evident to those skilled in this art may be made without departing from the spirit and scope of the invention, and the invention is thus not to be limited to the precise details of methodology or construction set forth above as such variations and modification are intended to be included within the scope of the invention.

I claim:

1. A three-dimensional polyhedrally shaped collapsible hollow ornamental structure which has opposite substantially flat front and back faces and a plurality of side faces, said hollow ornamental structure being made from a single blank of folding board or paperboard:

(a) said blank comprising (i) a longitudinal rectangular blank portion having opposite terminal end edges and a longitudinal center line, (ii) a medial transverse score line formed in said longitudinal blank portion and dividing said longitudinal blank portion into first and second halves each extending from said medial transverse score line to a respective one of said opposite terminal end edges of said longitudinal blank portion, and (iii) first and second transverse rectangular blank portions each of which perpendicularly intersects and extends beyond opposite longitudinal side edges of a respective one of said first and second halves of said longitudinal blank portion, each of said first and second transverse rectangular blank portions being located midway between said medial transverse score line and said terminal end edge of a respective one of said first and second halves of said longitudinal blank portion, and each of said first and second transverse blank portions terminating at respective opposite free ends thereof, (iv) each of said first and second halves of said longitudinal blank portion and its respective associated first and second transverse blank portions defining respective first and second main polygonal sections of said blank, and (v) each of said first and second main polygonal sections of said blank being, by virtue of the disposition relative thereto of the respective one of said first and second transverse blank portions, identically cruciform in shape, and said first and second main polygonal sections of said blank being, by virtue of the disposition relative thereto of said medial transverse score line, hingedly connected to and foldable over against each other along said medial transverse score line;

(b) each of said first and second main polygonal sections of said blank, at the respective intersection of said first and second half of said longitudinal blank portions with the respective first and second transverse blank portions, including (i) a respective one of said first and second central square regions each having boundaries which are defined by respective first and second sets of four mutually perpendicularly intersecting oblique score lines formed in said blank and oriented to dispose one diagonal of said first central square region colinearly with one diagonal of said second central square region on said longitudinal center line of said blank, and (ii) a respective one of said first and second outer surfaces overlying one of said first and second central square regions and, in the folded state of said blank, constituting said front face or said back face of said hollow ornamental structure;

(c) each of said first and second main polygonal sections of said blank further including a respective plurality of first right triangular outer regions and second right triangular outer regions, (i) said first right triangular outer regions being disposed circumferentially of said first central square region of said first main polygonal section and having respective hypotenuse side edges hingedly connected to respective parts of side edges of said first central square region by parts of the respectively associated first set of oblique score lines, (ii) said second right triangular outer regions being disposed circumferentially of said second central square region of said second main polygonal section and having respective hypotenuse side edges hingedly connected to respective parts of side edges of said second central square region by parts of the respectively associated second set of oblique score lines, and (iii) two of said first right triangular outer regions which are located between said first central square region and said medial transverse score line having respective leg side edges hingedly connected by said medial transverse score line to corresponding leg side edges of two of said second right triangular outer regions which are located between said second central square region and said medial transverse score line;

(d) said first main polygonal section of said blank further including (i) a transverse terminal score line at the respective terminal end edge of said first half of said longitudinal blank portion, and respective longitudinal terminal score lines at said opposite free ends of said first transverse blank portion, said terminal score lines defining outwardly directed leg side edges of said first right triangular outer regions other than said two first right triangular outer regions, and (ii) a plurality of outwardly extending tabs hingedly connected at respective inwardly directed side edges thereof by respective ones of said longitudinal or transverse terminal score lines to corresponding ones of said outwardly directed leg side edges of said first right triangular outer regions other than said two first right triangular outer regions; and (e) said tabs having configurations and sizes such that (i) each tab has an outline not greater than a respective one of said second right triangular outer regions, (ii) each tab is adapted, upon said blank being folded along said medial transverse score line so as to direct said first and second outer surfaces of said first and second main polygonal sections away from one another, to be folded over along its associated terminal score line into surface to surface engagement with at least a portion of said respective one of said second right triangular outer regions, and (iii) each tab is adapted, upon application of glue either to a surface of that tab or to a corresponding surface of that respective one of said second right triangular outer regions or to both of the surfaces, to be bonded to that respective one of said second right triangular outer regions, (f) whereby, upon said tabs being so bonded to said respective ones of said second right triangular outer regions, said blank is transformed into said collapsible hollow structure which is initially in a flat substantially two-dimensional state and can be expanded into a three-dimensional hollow state upon circumferential application of an inwardly directed compressive force to said first and second right triangular outer regions for displacing said first and second right triangular outer regions inwardly of said first and second central square regions and for concurrently displacing said first and second central square regions perpendicularly away from each other, and whereby, upon expansion of said hollow structure into its three-dimensional state, said first and second outer surfaces of said first and second central square regions define, respectively, said front and back faces of said hollow structure, and said first and second right triangular outer regions define at least parts of said side faces of said hollow structure.

2. A collapsible hollow ornamental structure as claimed in claim 1, further comprising an elastic band which, when said tabs are bonded to said respective ones of said second right triangular outer regions, generally equatorially tightly encircles said hollow ornamental structure and applies said inwardly directed compressive force to said first and second right triangular outer regions of said hollow ornamental structure and urges said hollow ornamental structure into its expanded three-dimensional state.

3. A collapsible hollow ornamental structure as claimed in claim 2, wherein said blank is provided in a midregion of said medial transverse score line with a small slit in which a portion of said encircling elastic band is accommodated for ensuring retention of said elastic band in place on said hollow ornamental structure.

4. A collapsible hollow ornamental structure as claimed in claim 3, wherein mutually confronting small portions of respective paired ones of said tabs where each pair adjoins an associated one of said terminal score lines are removed, thereby to form in the respective midregion of each of said terminal score lines a respective additional small slit in each of which an additional portion of said encircling elastic band is accommodated for ensuring retention of said elastic band in place on said hollow ornamental structure.

5. A collapsible hollow ornamental structure as claimed in claim 3, wherein said tabs are generally right triangular in shape.

6. A collapsible hollow ornamental structure as claimed in claim 5, wherein said right triangular outer regions and said tabs have the shape of isosceles right triangles.

7. A collapsible hollow ornamental structure as claimed in claim 6, wherein a corner region of each tab at the juncture between a hypotenuse side edge thereof and an inwardly directed leg side edge thereof is removed, thereby to form in a respective midregion of each of said terminal score lines a respective additional small slit in each of which an additional portion of said encircling elastic band is accommodated for ensuring retention of said elastic band in place on said hollow ornamental structure.

8. A collapsible hollow ornamental structure as claimed in claim 1, wherein at least one of said first and second main polygonal sections of said blank further includes, within the boundaries of the associated one of said first and second central square regions, a respective plurality of interior score lines some of which coincide with diagonals of that central square region and others of which are medially perpendicular to opposite parallel sides of that central square region, thereby to impart a generally star-like appearance to the associated one of said front and back faces of said hollow ornamental structure and to said hollow ornamental structure as a whole when the latter is expanded to its three-dimensional state.

9. A collapsible hollow ornamental structure as claimed in claim 8, further comprising an elastic band generally equatorially tightly encircling said hollow ornamental structure and applying said inwardly directed compressive force to said first and second right triangular outer regions of said hollow ornamental structure and urging the latter into its expanded three-dimensional state, and said blank being provided in a midregion of said medial transverse score line with a small slit in which a portion of said encircling elastic band is accommodated for ensuring retention of said elastic band in place on said hollow ornamental structure.

10. A collapsible hollow ornamental structure as claimed in claim 1, wherein each of said first and second main polygonal sections of said blank further includes, within the boundaries of the associated one of said first and second central square regions, a respective plurality of interior score lines some of which coincide with diagonals of that central square region and others of which are medially perpendicular to opposite parallel sides of that central square region, thereby to impart a generally star-like appearance to each of said front and back faces of said hollow ornamental structure and to said hollow ornamental structure as a whole when the latter is expanded to its three-dimensional state.

11. A collapsible hollow ornamental structure as claimed in claim 10, further comprising an elastic band generally equatorially tightly encircling said hollow ornamental structure and applying said inwardly directed compressive force to said first and second right triangular outer regions of said hollow ornamental structure and urging the latter into its expanded three-dimensional state, and said blank being provided in a midregion of said medial transverse score line with a small slit in which a portion of said encircling elastic band is accommodated for ensuring retention of said elastic band in place on said hollow ornamental structure.

12. A collapsible hollow ornamental structure as claimed in claim 1, wherein said blank is provided in a plurality of interior corner or side regions of at least one of said first and second central square regions thereof with a corresponding number of slits for releasably accommodating corner regions of a photograph or card.

13. A collapsible hollow ornamental structure as claimed in claim 12, wherein said blank is devoid of such slits in the other of said first and second central square regions.

14. A collapsible hollow ornamental structure as claimed in claim 12, wherein said slits are curved and are located each in a respective one of said corner regions of said at least one of said first and second central square regions.

15. A collapsible hollow ornamental structure as claimed in claim 14, wherein said slits are four in number, with each of said slits being located in a respective one of said corner regions of said at least one of said first and second central square regions.

16. A collapsible hollow ornamental structure as claimed in claim 15, wherein two of said four corner regions of said at least one of said first and second central square regions are located on a part of said longitudinal portion of said blank outside the confines of the associated one of said transverse blank portions, and the other two of said four corner regions of said at least one of said first and second central square regions are located on said associated transverse blank portion outside the confines of the associated part of said longitudinal blank portion, whereby upon said hollow ornamental structure being in its expanded three-dimensional state, the four corner regions of the associated one of said front and back faces of said hollow ornamental structure are bent relative to that front or back face in a direction toward the midplane of said hollow ornamental structure, and a photograph or card having its corner regions fitted into said slits assumes an arched configuration over that face of said hollow ornamental structure.

17. A collapsible hollow ornamental structure as claimed in claim 1, wherein at least said first main polygonal section of said blank further includes, within the boundaries of the associated first central square region, a plurality of mutually perpendicular first interior score lines which coincide with straight lines running longitudinally or transversely of said blank from the midpoint of each side of said associated first central square region to the midpoint of each next adjacent side of said associated first central square region, said first interior score lines thereby defining within said associated first central square region the boundaries of a first inner square region which is rotated by 45° with respect to said associated first central square region.

18. A collapsible hollow ornamental structure as claimed in claim 17, wherein said blank in a plurality of interior corner regions of said first inner square region within said associated first central square region is provided with a corresponding number of slits for releasably accommodating corner regions of a photograph or card, each of said slits being straight and extending from one side of said first inner square region to the next adjacent side of said first inner square region.

19. A collapsible hollow ornamental structure as claimed in claim 18, wherein said blank in a plurality of interior corner regions of said associated first central square region within the latter but outside said first inner square region is provided with a corresponding number of additional slits for releasably accommodating corner regions of a photograph or card.

20. A collapsible hollow ornamental structure as claimed in claim 19, wherein said additional slits are curved.

21. A collapsible hollow ornamental structure as claimed in claim 17, wherein said second main polygonal section of said blank includes, within the respective boundaries of the associated second central square region, a respective plurality of mutually perpendicular second interior score lines which coincide with straight lines running longitudinally or transversely of said blank from the midpoint of each side of said associated second central square region to the midpoint of each next adjacent side of said associated second central square region, said second interior score lines thereby defining within said associated second central square region the boundaries of a second inner square region which is rotated by 45° with respect to said associated second central square region.

* * * * *